US006118971A

United States Patent [19]

Sato et al.

[11] Patent Number: 6,118,971

[45] **Date of Patent: *Sep. 12, 2000**

[54] ORIGINAL-FEEDING DEVICE AND METHOD CAPABLE OF SEPARATING AND FEEDING THE UPPERMOST AND THE LOWERMOST ORIGINAL

[75] Inventors: Shunji Sato; Satoshi Choho, both of Tokyo, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/727,751

[22] Filed: Oct. 8, 1996

[30] Foreign Application Priority Data

Oct. 13, 1995 [JP] Japan ..... 7-290662

[51] Int. Cl.[7] ..... G03G 15/00; B65H 5/22

[52] U.S. Cl. ..... 399/368; 271/3.05; 271/3.08

[58] Field of Search ..... 399/367, 370, 399/371, 372, 368; 271/3.05, 3.08

[56] References Cited

U.S. PATENT DOCUMENTS

| | | | |
|---|---|---|---|
| 4,384,782 | 5/1983 | Acquaviva | 399/372 X |
| 4,940,225 | 7/1990 | Sato et al. | 271/296 |
| 5,084,741 | 1/1992 | Takemura et al. | 399/371 X |
| 5,125,636 | 6/1992 | Higashio et al. | 399/367 X |
| 5,220,395 | 6/1993 | Yamashita et al. | 399/367 X |
| 5,339,134 | 8/1994 | Nakamura et al. | 399/367 |
| 5,363,023 | 11/1994 | Choho | 318/70 |
| 5,669,056 | 9/1997 | Rubscha | 399/367 |

*Primary Examiner*—Fred L Braun

*Attorney, Agent, or Firm*—Fitzpatrick, Cella, Harper & Scinto

[57] ABSTRACT

In an original-feeding device and method, originals are conveyed from an original-tray on which a bundle of originals can be mounted to an original-reading mount. A control unit controls an original-conveying operation so as to separate and feed originals from the bundle of originals mounted on the original-tray onto the original-reading mount either from an uppermost original or from a lowermost original. The control unit can control the original-conveying operation to juxtapose two consecutive originals on the original-reading mount irrespective of whether the originals are fed from the uppermost or lower-most original. In addition, the number of originals in the bundle can be counted if certain conditions exist.

28 Claims, 10 Drawing Sheets

ORIGINAL-FEEDING DEVICE AND METHOD CAPABLE OF SEPARATING AND FEEDING THE UPPERMOST AND THE LOWERMOST ORIGINAL

BACKGROUND OF THE INVENTION

1. Field of the Invention

This invention relates to an original-feeding device capable of separating and feeding the uppermost original of a bundle of originals, and capable of separating and feeding the lowermost original of the bundle.

2. Description of the Related Art

In conventional original-feeding devices, originals are sequentially fed only either from the first page or the last page. In an ordinary original-copying operation, the copying operation starts, in most cases, from the last page in consideration of ease in processing of copying sheets.

Recently, copiers also having a facsimile function have been realized. In this kind of copiers, originals must be processed from the first page when the facsimile function operates. Accordingly, automatic original-feeding devices for such copiers have been proposed in which, when the copier performs a facsimile operation, processing starting from the first page (feeding of upper originals) is performed, and when the copier performs an ordinary original-copying operation, processing starting from the last page (feeding of lower originals) is performed.

However, in the above-described conventional automatic original-feeding devices capable of performing two kinds of original-feeding operations, i.e., processing starting from the first page and processsing starting from the last page, it is impossible to perform control of an original-feeding operation which allows a duplex mode of performing copying or facsimile transmission of an original having printed images on both surfaces thereof, or a 2-in-1 mode of copying two originals on one copying sheet or performing facsimile transmission of two originals without providing an interval between the two originals to provide a situation as if a single original were transmitted.

When, for example, obtaining a duplex copy from a simplex original, it is necessary to know whether the number of originals mounted on an original-mounting tray is even or odd when starting processing from the last page. On the other hand, when starting processing from the first page, it is unnecessary to know whether the number of originals mounted on an original-mounting tray is even or odd even when reading both surfaces of a simplex original. Hence, it is wasteful to detect whether the number of mounted originals is even or odd for the latter case.

SUMMARY OF THE INVENTION

It is an object of the present invention to provide an original-feeding device which solves the above-described problems.

It is another object of the present invention to provide an original-feeding device in which, when performing control of an original-conveying operation so as to separate/feed a bundle of originals mounted on an original-tray onto an original-reading mount either from the upper-most original or from the lowermost original, the originals can be disposed on the original-reading mount in various forms, and the number of the mounted originals is not wastefully counted.

According to one aspect, the present invention which achieves these objectives relates to an original-feeding device in which originals are conveyed from an original-tray, on which a bundle of originals can be mounted, to an original-reading mount, comprising control means for controlling an original-conveying operation so as to selectively separate and feed originals from the bundle of originals mounted on the original-tray onto the original-reading mount either from an uppermost original or from a lowermost original, wherein the control means can control the original-conveying operation to juxtapose two consecutive originals on the original-reading mount irrespective of whether the originals are separated and fed from the uppermost original or from the lowermost original.

According to another aspect, the present invention which achieves these objectives relates to an original-feeding method of conveying originals from an original-tray to an original-reading mount, comprising the step of controlling an original-conveying operation so as to selectively separate and feed the originals from the bundle of originals mounted on the original-tray onto the original-reading mount either from an uppermost original or from a lowermost original, wherein the control step can include controlling the original-conveying operation to juxtapose two consecutive originals on the original-reading mount when the originals are separated and fed either from the upper-most original or from the lowermost original.

The foregoing and other objects, advantages and features of the present invention will become more apparent from the following detailed description of the preferred embodiment taken in conjunction with the accompanying drawings.

DETAILED DESCRIPTION OF THE PREFERRED EMBODIMENT

A preferred embodiment of the present invention will now be described with reference to the drawings.

Figure 1:
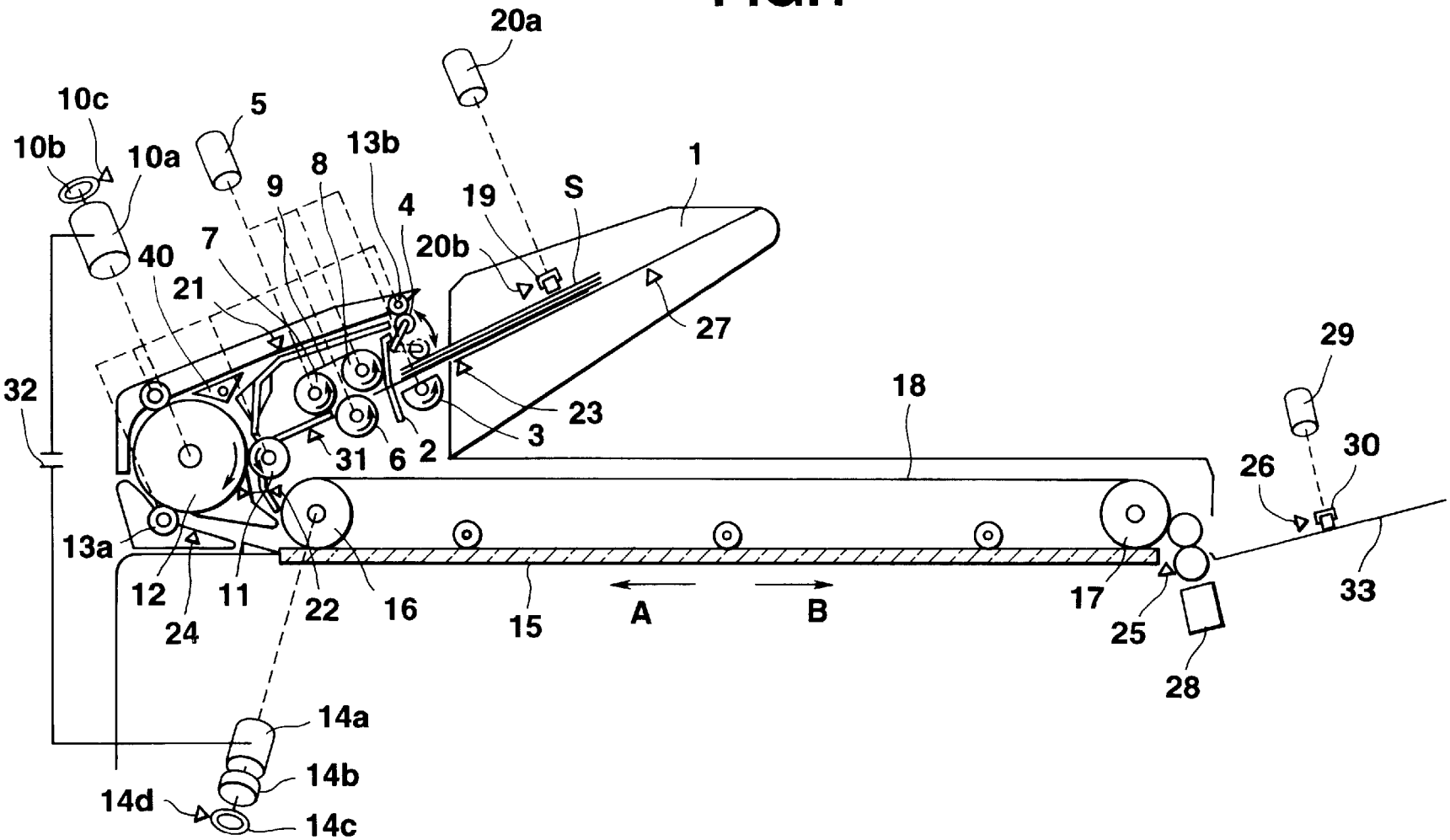
FIG. 1 is a schematic diagram illustrating the configuration of an automatic original-feeding device (RDF (recycling document feeder)) according to an embodiment of the present invention.

FIG. 1 is a schematic diagram illustrating the configuration of an automatic original-feeding device (RDF) according to the preferred embodiment.

The automatic original-feeding device (RDF) includes an original-mounting tray 1, an original-stopper 2, a semicircular roller 3, a pickup roller 4, a separation motor 5, a feeding roller 6, separation rollers 7 and 8, a separation belt 9, a sheet feeding motor 10*a*, a sheet-feeding-clock-signal disc 10*b*, a sheet-feeding-motor-clock-signal sensor 10*c*, feeding rollers 11 and 12, a first discharging roller 13*a*, a second discharging roller 13*b*, a belt motor 14*a*, an electromagnetic brake 14*b*, a belt-clock-signal disc 14*c*, a belt-clock-signal sensor 14*d*, platen glass (also called an original-reading mount or original-glass) 15, a belt driving roller 16, a turn roller 17, a full-face belt 18, a recycle lever 19, a recycle-lever driving motor 20*a*, a recycle-lever-reference-position detection sensor 20*b*, a first discharged-sheet sensor 21, a registration sensor 22, an original-detection sensor 23, a reversal sensor 24, a second discharged-sheet sensor 25, a discharged-original-partitioning-lever-reference-position sensor 26, an original-size-in-conveying-direction detection sensor 27, a stamp solenoid 28, a discharged-original-partitioning-lever driving motor 29, a discharged-original partitioning lever 30, a separation sensor 31, an electromagnetic clutch 32, and a discharged-original tray 33.

By utilizing the above-described components, the automatic original-feeding device (RDF) can perform switching between an upper-sheet separation mode for individually conveying (feeding) a bundle S of originals mounted on the original-mounting tray 1 toward the original-glass 15 from the uppermost original (the first page), and a lower-sheet separation mode for individually conveying (feeding) the originals toward the original-glass 15 from the lowermost original (the last page), for the bundle S of originals.

Furthermore, the automatic original-feeding device (RDF) can perform switching among a simplex-original mode of performing a sheet feeding operation in order to read information of a simplex original having the information recorded only on one surface thereof, a duplex-original mode of performing a sheet feeding operation in order to read information of both surfaces of a duplex original having the information recorded on both surfaces thereof, and a 2-in-1 (juxtaposition) mode of performing a sheet feeding operation so as to juxtapose two originals on the original-glass 15 in order to read two (simplex) originals and record the read images of the originals on a single recording sheet.

The original-mounting tray 1 is disposed so as to incline downward in the original-feeding direction so that the bundle S of originals is mounted to be aligned in the original-feeding direction. In order to prevent skew of an original while the original is conveyed, an original-regulating plate (not shown) is provided on the original-mounting tray 1. An original-width-detection variable resistor (not shown in FIG. 1, discussed later in connection with FIG. 2) linked with the original-regulating plate is connected thereto, so that the width size of the original can be detected by detecting the voltage value corresponding to the position of the original-regulating plate. The original-size-in-conveying-direction detection sensor 27 is provided on the original-mounting tray 1. It is possible to determine in advance before starting an original-feeding operation if two originals can be juxtaposed on the platen glass 15, based on the size of the originals in the conveying direction detected by the original-size-in-conveying-direction detection sensor 27.

The semicircular roller 3 sequentially feeds the originals mounted on the original-mounting tray 1 from the lowermost original (the last page) to a separation unit provided at the downstream side. The semicircular roller 3 is controlled such that, when an original is present on the original-mounting tray 1 and feeding is to be done from the lowermost original, the semicircular roller 3 is rotated in the direction of the arrow. When there is no original on the original-mounting tray 1, and when sequentially feeding originals from the uppermost original (the first page) to the separation unit provided at the downstream side, the semicircular roller 3 stops its rotation with its notch portion placed up.

The recycle lever 19 is driven by the recycle motor 20*a* when starting an original-feeding operation, and is mounted on the uppermost original of the bundle of originals in order to discriminate between the last original to be fed and originals subjected to copying processing. When performing copying processing, since originals subjected to copying processing are returned to the original-mounting tray 1 and must be discriminated from the last original to be fed, the recycle lever 19 is driven. On the other hand, when performing facsimile transmission processing, since originals subjected to copying processing are discharged onto the discharged-original tray 33 without being returned to the original-mounting tray 1, the recycle lever 19 is not driven.

It is possible to perform precounting of the number of the originals mounted on the original-mounting tray 1, by executing a simplex-original conveying operation (to be described later) without performing a copying operation until it becomes clear that the last original has been conveyed, i.e., all originals have been conveyed. This is done by the detection by the recycle-lever-reference-position detection sensor 20*b* that the recycle lever 19 mounted on the bundle S of originals has dropped below the surface of the original-mounting tray 1. By notifying the counted number of the originals to the main body of the copier, the main body of the copier can appropriately perform, for example, processing to be performed when the number of originals is odd when, for example, obtaining a duplex copy from a simplex original. The counting of the number of mounted originals is performed only under specific conditions, which will be described later.

The pickup roller 4 improves conveyability of originals by being pressed against the bundle S of originals by the pickup-roller driving solenoid 4*a* (not shown in FIG. 1, see FIG. 2), and by being rotatably driven by the sheet feeding motor 10*a*. When sequentially feeding the originals from the lowermost original (the last page), the pickup roller 4 is not rotated, and when sequentially feeding the originals from the uppermost original (the first page), the pickup roller 4 is rotatably driven.

The separation unit comprises the feeding roller 6, the separation rollers 7, 8, and the separation belt 9 wound around the separation rollers 7, 8. The feeding roller 6 and the separation rollers 7, 8 are rotatably driven by the separation motor 5. When feeding the originals from the lowermost original (the last page), by rotatably driving the feeding roller 6 and the separation rollers 7, 8 in the direction indicated by the arrows in FIG. 1, the lowermost original is separated and fed from among a plurality of originals sequentially fed from the lowermost original (the last page). When feeding originals from the uppermost original (the first page), by rotatably driving the feeding roller 6 and the separation rollers 7, 8 in a direction opposite to the direction indicated by the arrows in FIG. 1, the uppermost original is separated and fed from among a plurality of originals sequentially fed from the uppermost original (the first page).

The original fed from the separation unit is grasped between the feeding rollers 11, 12, in pressure contact with each other, driven by the sheet feeding motor 10*a*, and is fed onto the platen glass 15 by the rotation of the feeding rollers 11, 12 in the directions of the arrows. At that time, by measuring the amount of pulses of the sheet-feeding-motor-clock-signal sensor 10*c* while the original conveyed by the feeding rollers 11, 12 passes through the registration sensor 22, the length of the original in the conveying direction can be detected. The sheet feeding motor 10a also drives the first discharging roller 13*a* and the second discharging roller 13*b*.

The full-surface belt 18 on the platen glass 15 is an endless belt having a width to cover the entire surface of the sheet-like original. The surface of the full-surface belt 18 has a sufficient coefficient of friction to convey the original in two directions by gliding it with the frictional force. The full-surface belt 18 is stretched between the driving roller 16 and the turn roller 17, and is configured to avoid slip between the full-surface belt 18 and the driving roller 16. The driving roller 16 is rotatably driven by the belt motor 14*a*.

The original conveyed onto the platen glass 15 is read and processed by the main body of the copier in order to perform copying processing or facsimile transmission processing. Thereafter, if subjected to copying processing, the original is returned onto the original-mounting tray 1, or, if subjected to facsimile transmission processing, the original is discharged onto the discharged-original tray 33.

When being returned onto the original-mounting tray 1, the original is discharged from the platen glass 15 by the movement of the full-surface belt 18 in the direction of an arrow A shown in FIG. 1. The original is conveyed by being grasped between the first discharging roller 13*a* and the feeding roller 12, in pressure contact with each other, rotating in the directions of the arrows.

When being discharged onto the discharged-original tray 33, the original is guided in the direction of an arrow B shown in FIG. 1 onto the discharged-original tray 33 by the full-surface belt 18. At that time, by driving the stamp solenoid 28 in response to an instruction from the main body of the copier, a "read" stamp is stamped on a predetermined position of the original to be discharged as a mark indicating completion of an original-reading operation.

The above-described original-conveying operation is repeated until all of the originals mounted on the original-mounting tray 1 are fed, or until an instruction to stop the original-conveying operation is provided.

Figure 2:
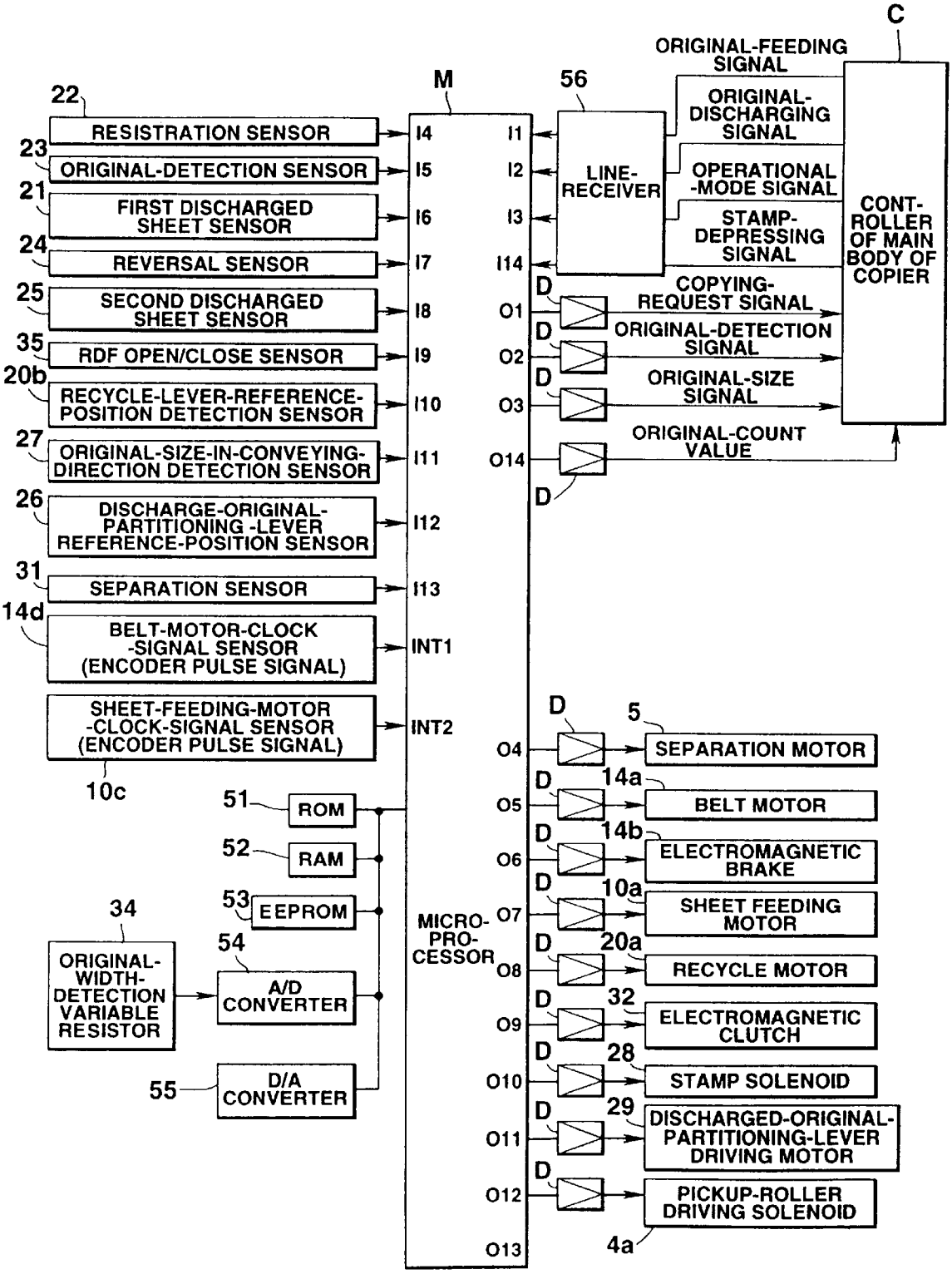
FIG. 2 is a block diagram of a control circuit for controlling the automatic original-feeding device (RDF) shown in FIG. 1.

FIG. 2 is a block diagram of a control circuit for controlling the automatic original-feeding device (RDF) shown in FIG. 1.

This control circuit controls various kinds of automatic original-feeding operations while exchanging signals with a controller C of the main body of the copier principally by the function of a single-chip microprocessor M.

That is, an original-feeding signal, an original-discharging signal, an operational-mode signal and a stamp-depressing signal from the controller C of the main body of the copier are input to input ports I1–I3 and I14, respectively, of the microprocessor M via a line receiver 56. Signals from the registration sensor 22, the original-detection sensor 23, the first discharged-sheet sensor 21, the reversal sensor 24, the second discharged-sheet sensor 25, an RDF open/close sensor 35 (omitted in FIG. 1), the recycle-lever-reference-position detection sensor 20*b*, the original-size-in-conveying-direction detection sensor 27, the discharged-original-partitioning-lever-reference-position sensor 26 and the separation sensor 31 are input to input ports I4–I13, respectively, of the microprocessor M.

Respective encoder pulse signals from the belt-motor-clock-signal sensor 14*d* and the sheet-feeding-motor-clock-signal sensor 10*c* are input to interrupt terminals INT1 and INT2, respectively, of the microprocessor M. These encoder pulse signals serve as reference clock signals for the amount of movement of the fed sheet, and are counted by an internal counter of the microprocessor M.

A copying request signal, an original-detection signal, an original-size signal and an original-precount value are output from output ports O1–O3 and O14, respectively, to the controller C of the main body of the copier via corresponding drivers D. Operation signals for the separation motor 5, the belt motor 14*a*, the electromagnetic brake 14*b*, the sheet feeding motor 10*a*, the recycle-lever driving motor 20*a*, the electromagnetic clutch 32 (see FIG. 1), the stamp solenoid 28, the discharged-original-partitioning-lever driving motor 29 and the pickup-roller driving solenoid 4*a* are output from output ports O4–O12, respectively, of the microprocessor M via corresponding drivers D.

The operational-mode signal comprises three kinds of signals, i.e., a mode signal indicating upper-sheet separation or lower-sheet separation, a mode signal indicating one of a simplex original, a duplex original and 2-in-1, and a mode signal indicating whether or not the number of originals mounted on the original-mounting tray 1 is to be counted.

A ROM (read-only memory) 51 stores control programs represented by flowcharts shown in FIGS. 9 and 10, discussed later, and the like. A RAM (random access memory) 52 is utilized, for example, as operation areas for calculation.

An EEPROM (electrically erasable and programmable read-only memory 53) is provided as a nonvolatile memory. An A/D (analog-to-digital) converter 54 is provided for reading voltage values, and a D/A (digital-to-analog) converter 55 serves as output-voltage changing means. Each of these is connected to the microprocessor M as shown. An original-width-detection variable resistor 34, linked with the original-regulating platen provided on the original-tray 1, is connected to the A/D converter 54. By detecting the voltage value associated with the variable resistor 34, the width of the mounted original can be detected.

Next, a description will be provided of the original-conveying operation in each operational mode with respect to FIGS. 3(A) through 8(F).

FIGS. 3(A)–3(E) are diagrams illustrating the original-conveying operation in a simplex-original/lower-separation mode set mainly during copying processing.

Referring to FIG. 1, in a simplex-original/lower-sheet separation mode, originals mounted on the original-mounting tray 1 are sequentially fed from the lowermost original (the last page of the originals), and the fed original is mounted on the platen glass (original-glass) 15. After the image of the original on the platen glass 15 is read, the original is conveyed and discharged onto the original-mounting tray 1. FIGS. 3(A), 3(B), 3(C), 3(D) and 3(E) illustrate a state when an operation of feeding the original is started, a state during the original-feeding operation, a state in which an operation of mounting the original has been completed and an operation of reading the original is performed, a state in which an operation of discharging the original is started, and a state in which the original is being discharged, respectively.

In the simplex-original/lower-sheet separation mode, the number of originals mounted on the original-mounting tray 1 is, in some cases, counted. The counting of the number of the originals is performed by executing the original-conveying operation except the reading processing shown in FIG. 3(C) for all of the originals mounted on the original-mounting tray 1 before starting actual conveyance for the reading processing (the same holds in any other mode).

FIGS. 4(A)–4(H) are diagrams illustrating the original-conveying operation in a duplex-original/lower-sheet separation mode set mainly during copying processing.

As shown in FIGS. 4(A)–4(H), in the duplex-original/lower-sheet separation mode, originals mounted on the original-mounting tray 1 are sequentially fed from the lowermost original (the last page of the originals). In order to read both a first surface and a second surface of the fed original, the original whose first surface has been read is automatically reversed and then the second surface is read.

Figure 4A:
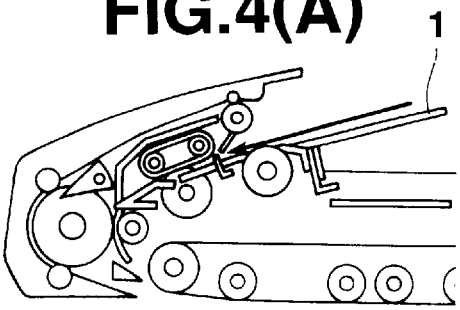
FIGS. 4(A)–4(H) are diagrams illustrating an original-conveying operation in a duplex-original/lower-sheet separation mode.
Figure 4B:
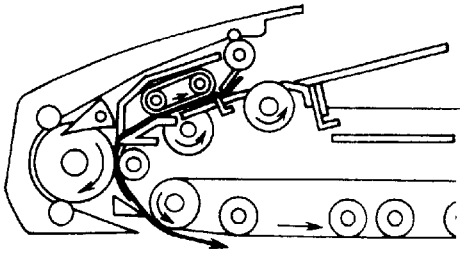
Figure 4C:
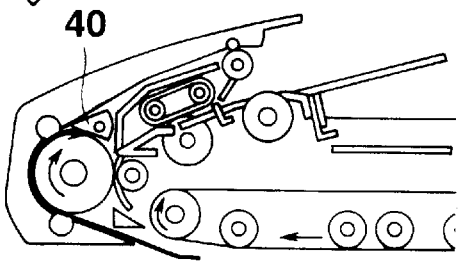
Figure 4D:
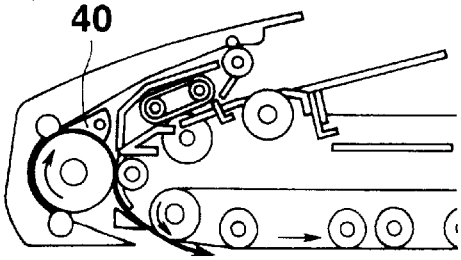
Figure 4E:
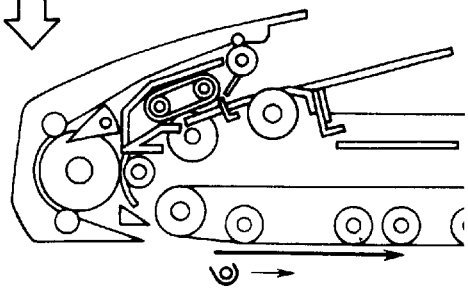
Figure 4F:
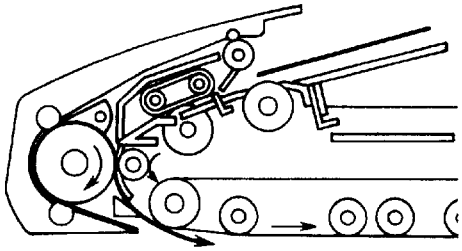
Figure 4G:
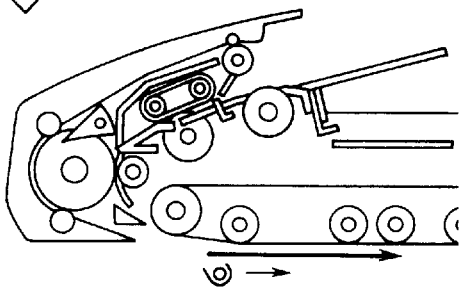
Figure 4H:
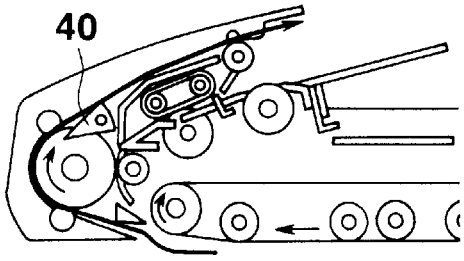

The originals mounted on the original-mounting tray 1 are sequentially fed from the lowermost original (the last page of the originals) (FIGS. 4(A) and 4(B)), the fed original is then reversed (FIGS. 4(C) and 4(D)) and is set so that the second surface can be read, and the second surface is read by the main body of the copier (FIG. 4(E)). After reading the second surface, the original is again reversed (FIG. 4(F)), and the first surface is set, and read by the main body of the copier (FIG. 4(G)). After reading the second surface, the original is discharged onto the original-mounting tray 1 (FIG. 4(H)). As shown in FIGS. 4(C) and 4(D), when reversing the original, a flapper 40 is set to the upper side. As shown in FIG. 4(H), when discharging the original, the flapper 40 is set to the lower side.

In the duplex-original/lower-sheet separation mode, number of the originals mounted on the original-mounting tray 1 is not subjected to precounting. As can be seen from FIG. 4(D) and the like, the state of the original in the longitudinal direction is not reversed from the state in which the original is mounted on the original-mounting tray 1. Here, the word "reversed" does not indicate a reversal of the state of the original in the longitudinal direction, but indicates a situation in which the original already conveyed onto the original-reading mount 15 is conveyed again onto the original-reading mount 15 while reversing the surface of the original which is exposed to the original-reading mount 15.

FIGS. 5(A)–5(G) are diagrams illustrating the original-conveying operation in a 2-in-1/lower-sheet separation mode set mainly during copying processing.

In the 2-in-1/lower-sheet separation mode, originals mounted on the original-mounting tray 1 are sequentially fed from the lowermost original, and two originals are simultaneously read. In order to perform the simultaneous reading operation, the first original P1 is reversed (FIGS. 5(A), 5(B) and 5(C)). In order to reverse again the placed first sheet, the first original is conveyed through a reversal path (the path of the first discharging roller 13*a*), and the second original P2 is also conveyed through another path (an ordinary path where reversal is not performed: the path of the feeding roller 11) (FIG. 5(D)). In this case, device is configured so that there is no interval between the leading edge of the first original P1 and the trailing edge of the second original P2 at the confluence of the two paths.

Figure 5A:
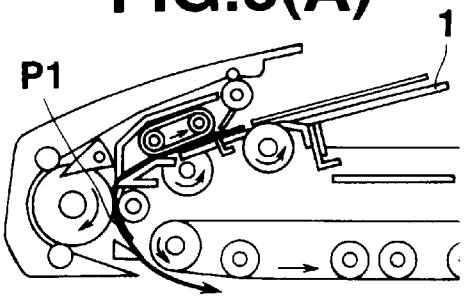
FIGS. 5(A)–5(G) are diagrams illustrating an original-conveying operation in a 2-in-1/lower-sheet separation mode.
Figure 5B:
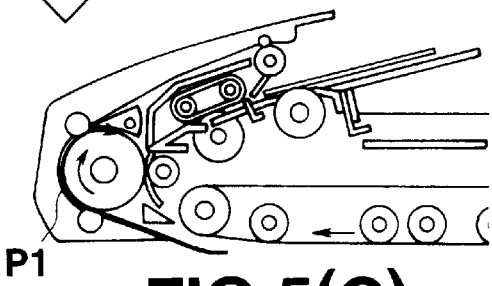
Figure 5C:
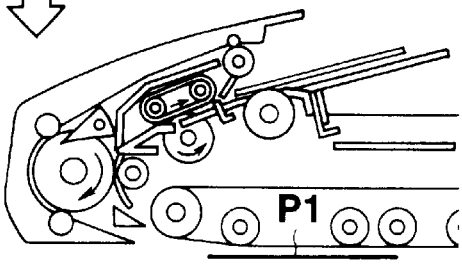
Figure 5D:
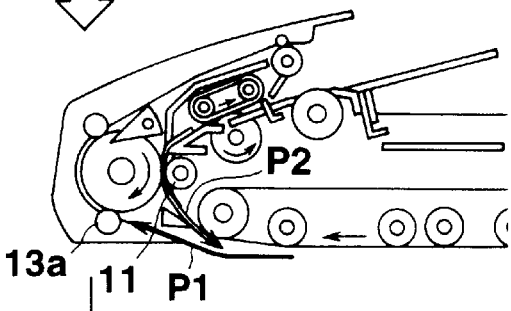
Figure 5E:
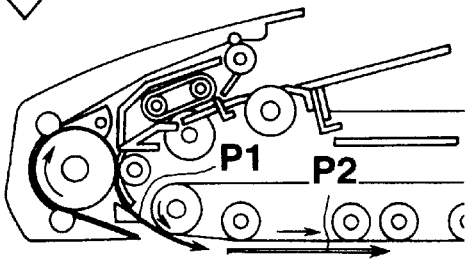
Figure 5F:
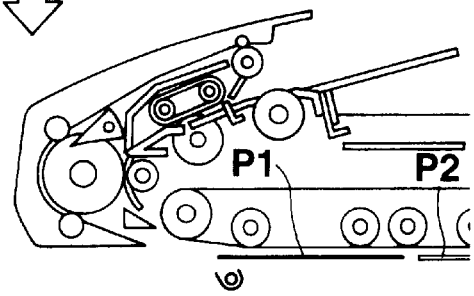
Figure 5G:
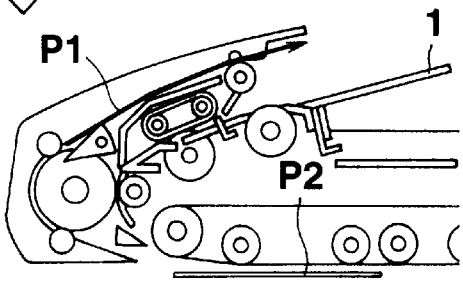

The first and second originals P1, P2 joined in the above-described manner are simultaneously read (FIGS. 5(E) and 5(F)), and are then returned onto the original-reading tray 1 in the sequence of the first original P1 and the second original P2 (FIG. 5(G)).

In the 2-in-1/lower-sheet separation mode, the number of the originals mounted on the original-mounting tray 1 is, in some cases, counted.

FIGS. 6(A)–6(E) are diagrams illustrating the original-conveying operation in a simplex-original/upper-sheet separation mode set mainly during facsimile transmission processing.

Figure 6A:
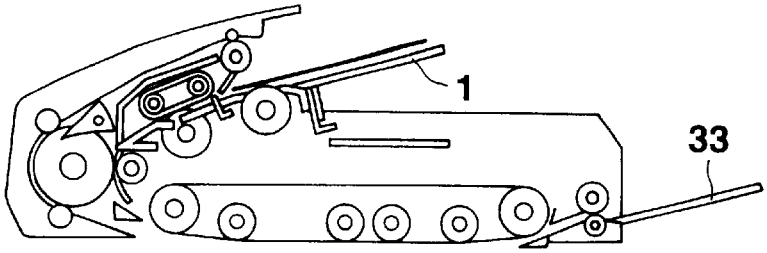
FIGS. 6(A)–6(E) are diagrams illustrating an original-conveying operation in a simplex-original/upper-sheet separation mode.
Figure 6B:
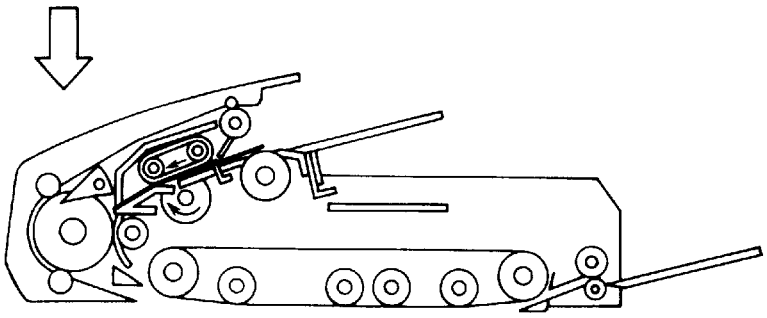
Figure 6C:
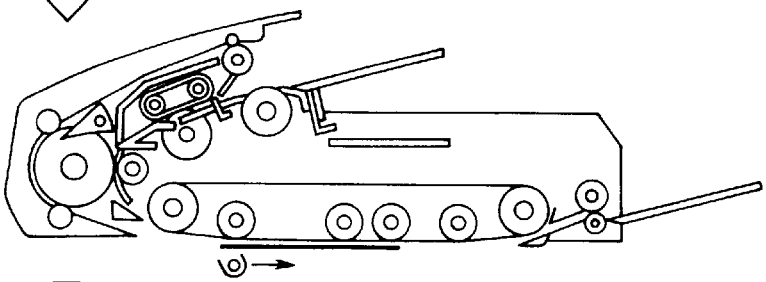
Figure 6D:
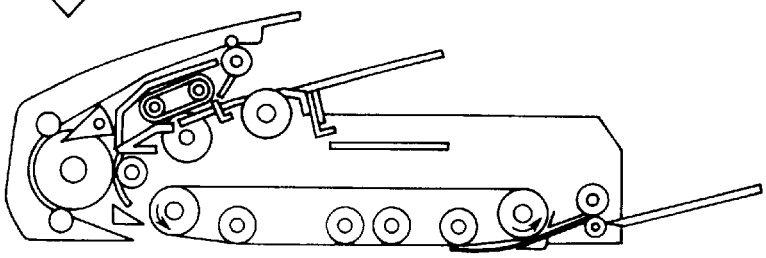
Figure 6E:
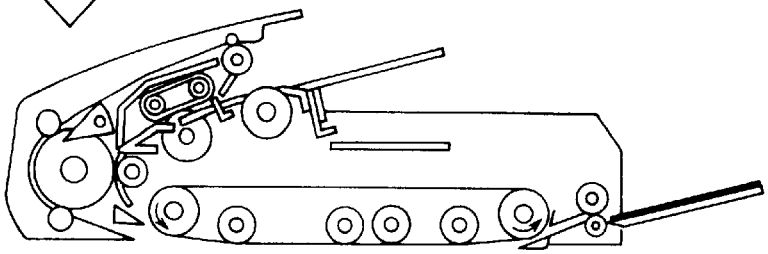

In the simplex-original/upper-sheet separation mode, originals mounted on the original-mounting tray 1 are sequentially fed from the uppermost original (the first page of the originals) (FIGS. 6(A) and 6(B)), and the fed sheet is mounted onto the platen glass (original-glass) 15 (FIG. 6(C)). After the image on the original has been read, the original on the original-glass 15 is conveyed (FIG. 6(D)), and is discharged onto the discharged-original tray 33 (FIG. 6(E)).

In the simplex-original/upper-sheet separation mode, the number of the originals mounted on the original-mounting tray 1 is not subjected to precounting.

FIGS. 7(A)–7(I) are diagrams illustrating the original-conveying operation in a duplex-original/upper-sheet separation mode set mainly during facsimile transmission processing.

Figure 7A:
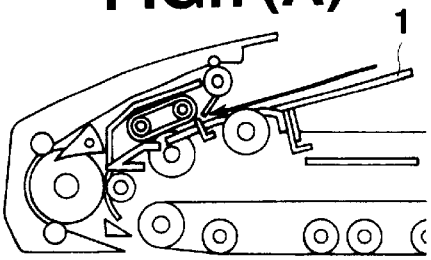
FIGS. 7(A)–7(I) are diagrams illustrating an original-conveying operation in a duplex-original/upper-sheet separation mode.
Figure 7B:
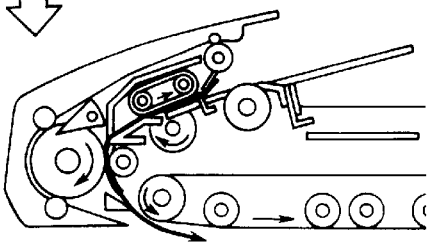
Figure 7C:
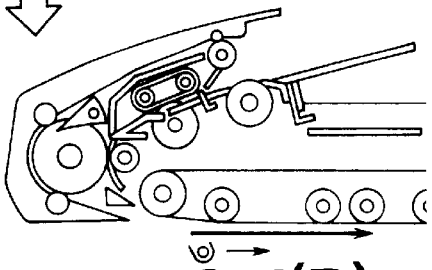
Figure 7D:
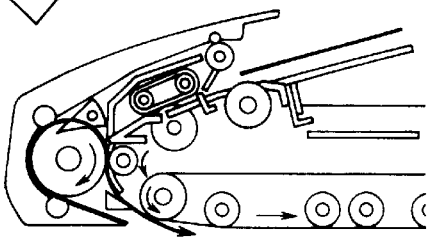
Figure 7E:
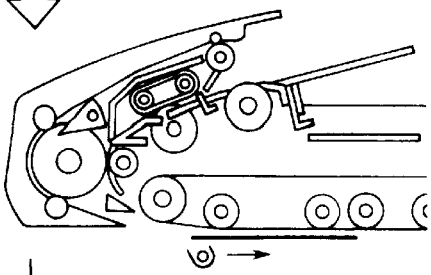
Figure 7F:
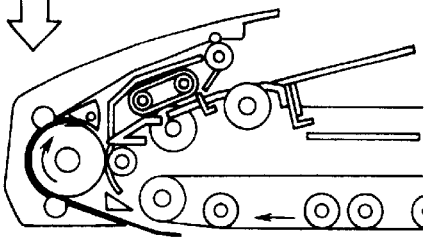
Figure 7G:
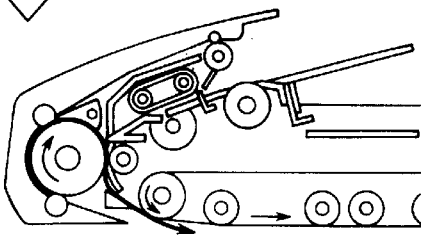
Figure 7H:
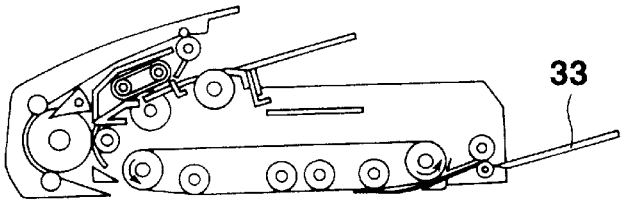
Figure 7I:
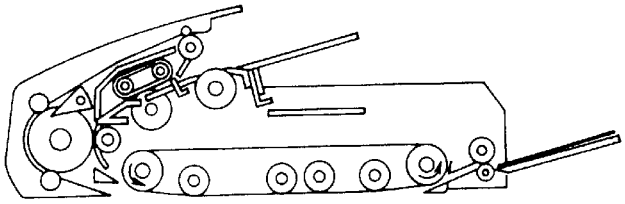

In the duplex-original/upper-sheet separation mode, originals mounted on the original-mounting tray 1 are sequentially fed from the uppermost original (the first page of the originals), and a first surface of the first original is set (FIGS. 7(A), 7(B) and 7(C)), and is read (FIG. 7(C)). Then, the original is reversed and set (FIGS. 7(D) and 7(F)), and a second surface of the original is read (FIG. 7(E)). Then, the original is again reversed (FIGS. 7(F) and 7(G)), and is discharged onto the discharged-original tray 33 (FIGS. 7(H) and 7(I)).

In the duplex-original/upper-sleet separation mode, the number of the originals mounted on the original-mounting tray 1 is not subjected to precounting.

FIGS. 8(A)–8(F) are diagrams illustrating the original conveying operation in a 2-in-1/upper-sheet separation mode set mainly during facsimile transmission processing.

Figure 8A:
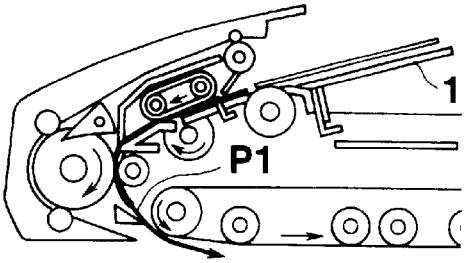
FIGS. 8(A)–8(F) are diagrams illustrating an original-conveying operation in a 2-in-1/upper-sheet separation mode.
Figure 8B:
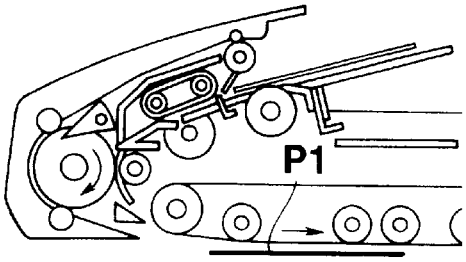
Figure 8C:
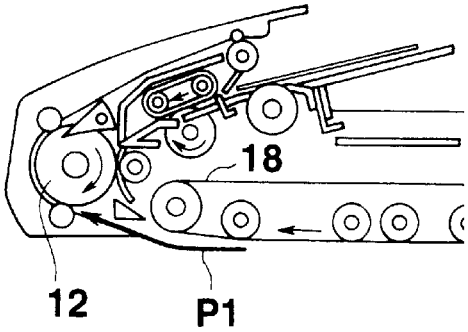
Figure 8D:
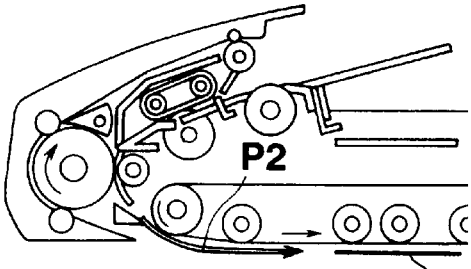
Figure 8E:
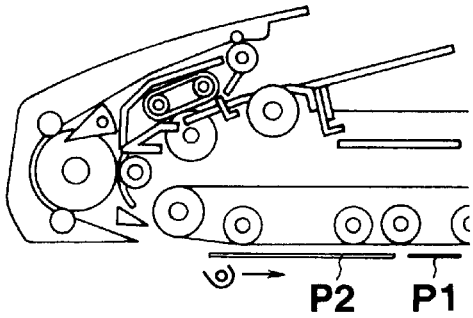
Figure 8F:
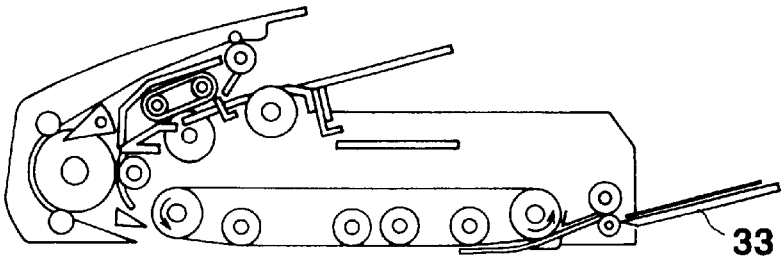

In the 2-in-1/upper-sheet separation mode, originals mounted on the original-mounting tray 1 are sequentially fed from the uppermost original (the first page of the originals), and the first fed original P1 is mounted (FIGS. 8(A) and 8(B)) and is then conveyed in a reverse direction by a predetermined amount to such a degree that the original does not reach the roller 12 (FIG. 8(C)). Then, the second original P2 is fed, and is stopped before the full-face belt 18, and a state in which no spacing is present between the trailing edge of the first original P1 and the leading edge of the second original P2 is provided (FIG. 8D)). Thereafter, by simultaneously driving the roller 12 and the full-face belt 18, the first and second originals are simultaneously conveyed onto and set on the original-glass 15 (FIG. 8(E)). The first and second originals P1, P2 are simultaneously read (FIG. 8(E)), and the two originals are then discharged onto the discharged-original tray 33 (FIG. 8(F)).

In the 2-in-1/upper-sheet separation mode, the number of the originals mounted on the original-mounting tray 1 is not subjected to precounting.

Figure 9:
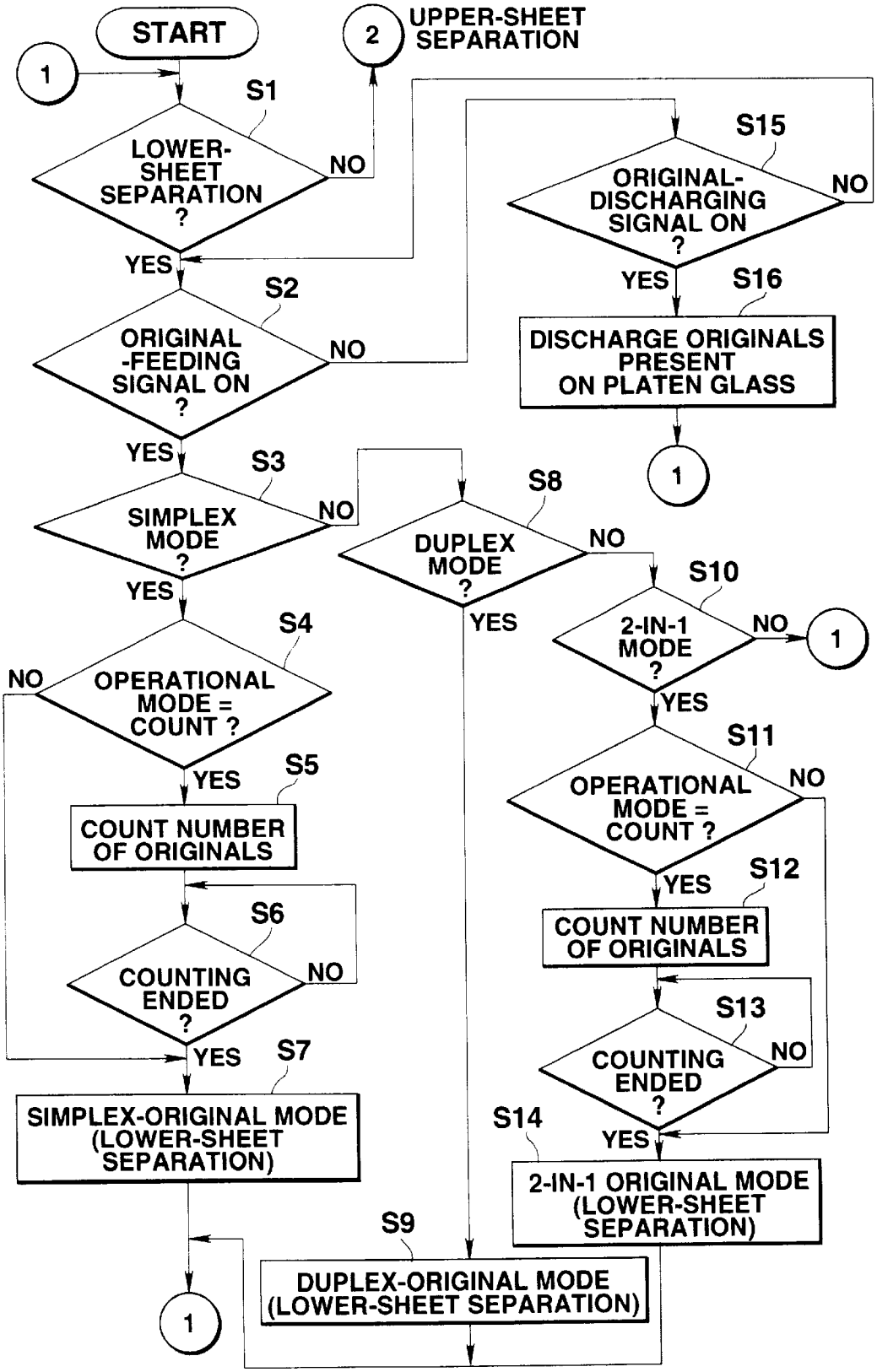
FIGS. 9 and 10 are flowcharts illustrating an original-feeding operation in the embodiment.
Figure 10:
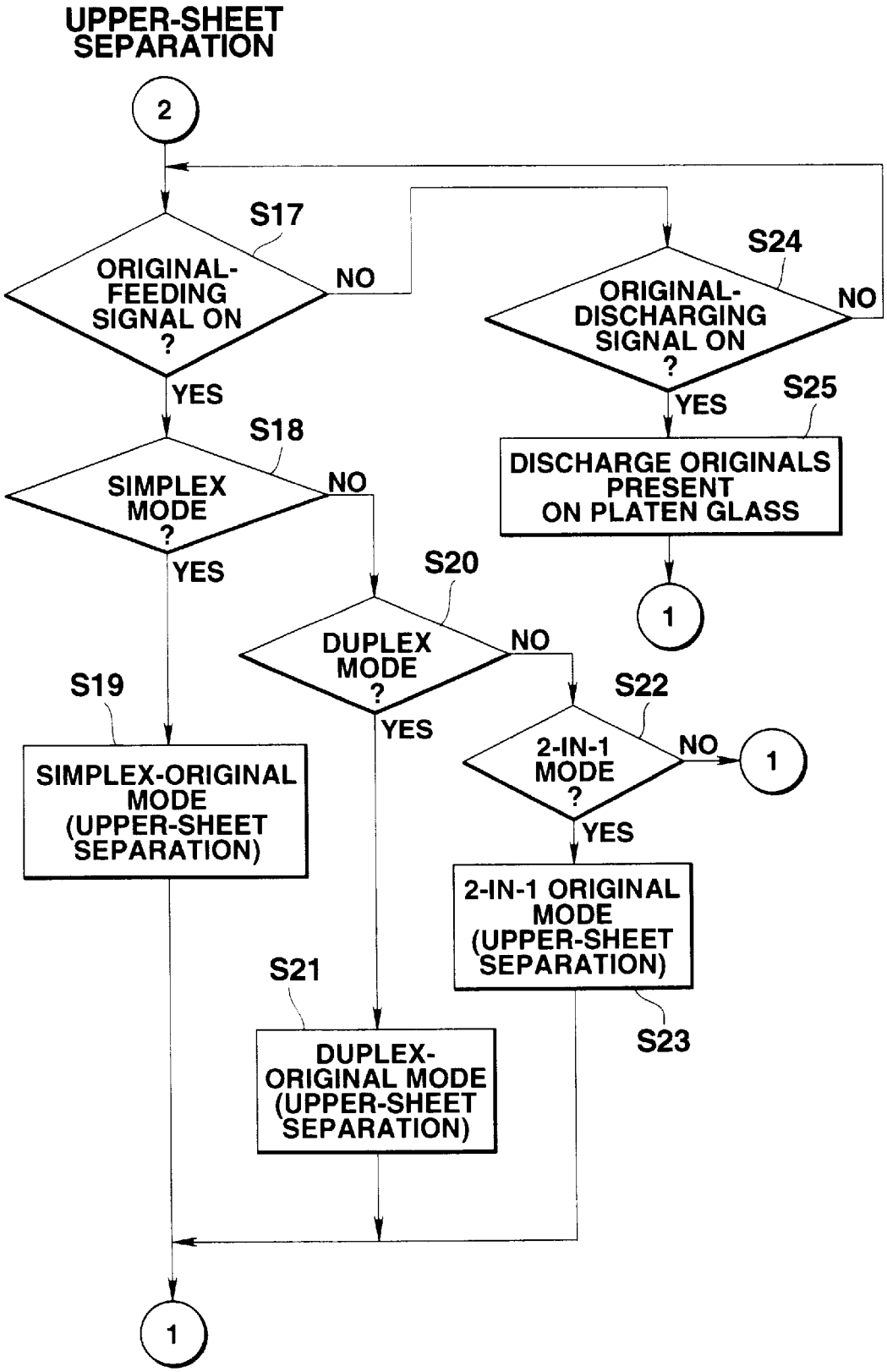

Next, a description will be provided of the original-conveying operation in the embodiment with reference to the flowcharts shown in FIGS. 9 and 10.

The microprocessor M first checks an operational-mode signal input from the controller C of the main body of the copier according to a program preset in the ROM 51, and determines if the lower-sheet separation mode is set (step S1). If the result of the determination in step S1 is affirmative, it is then determined if an original-feeding signal input from the controller C is "on" (step S2). If the result of the determination in step S2 is affirmative, the microprocessor M checks an operational-mode signal input from the controller C, and determines if the simplex-original mode is set (step S3).

Figure 3A:
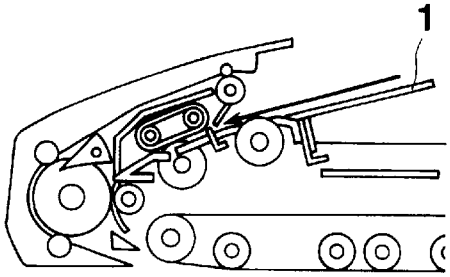
FIGS. 3(A)–3(E) are diagrams illustrating an original-conveying operation in a simplex-original/lower-sheet separation mode.
Figure 3B:
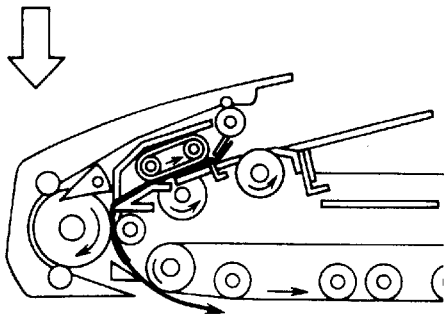
Figure 3C:
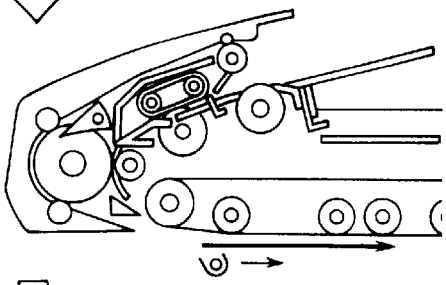
Figure 3D:
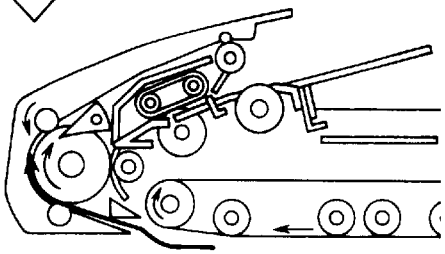
Figure 3E:
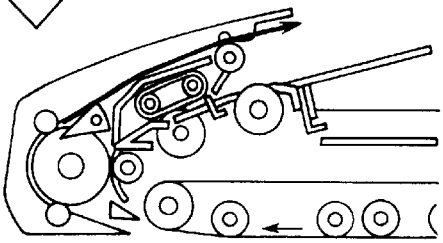

If the result of the determination in step S3 is affirmative, the microprocessor M checks an operational-mode signal input from the controller C, and determines if a count mode is set (step S4). In a mode of performing copying on both surfaces of a recording sheet by the main body of the copier and automatically controlling the device so that no blank page is present before the page, the main body of the copier outputs a signal indicating that the count mode is set. If the result of the determination in step S4 is affirmative, the number of the originals mounted on the original-mounting tray 1 is counted by performing the conveyance control shown in FIGS. 3(A)–3(E) (the reading processing shown in FIG. 3(C) is not performed) (step S5).

In step S6, the microprocessor M determines if the counting of the number of the originals has been completed. If the result of the determination in step S6 is affirmative, the conveying processing in the simplex-original/lower-sheet separation mode shown in FIGS. 3(A)–3(E) is performed (step S7), and the process returns to step S1. If the result of the determination in step S4 is negative, the process proceeds to step S7 by skipping steps S5 and S6. In step S7, the conveying processing in the simplex-original/lower-sheet separation mode shown in FIGS. 3(A)–3(E) is performed. (However, the processing of discharging the read original onto the original-mounting tray 1 or the discharged-original tray 33 is not performed in this processing. The same holds for steps S9, S14, S19, S21 and S23 (to be described later)).

If the result of the determination in step S3 is negative, the microprocessor M then determines if the duplex-original mode is set (step S8). If the result of the determination in step S8 is affirmative, i.e., if the duplex-original/lower-sheet separation mode is set, the conveying processing in the duplex-original/lower-sheet separation mode shown in FIGS. 4(A)–4(H) is performed (step S9), and the process returns to step S1. That is, in the duplex-original/lower-sheet separation mode, it is unnecessary to know the number of the originals in advance because both surfaces of the original are read. Hence, the counting of the number of the originals is not performed irrespective of lower-sheet separation.

If the result of the determination in step S8 is negative, the microprocessor M then determines if the 2-in-1 mode is set (step S10). If the result of the determination in step S10 is affirmative, i.e., if the 2-in-1/lower-sheet separation mode is set, the microprocessor M checks an operational-mode signal input from the controller C, and determines if the count mode is set (step S11). In a mode of performing automatic control so that no blank page is formed before the first page, the main body of the copier outputs a signal indicating that the count mode is set. If the result of the determination in step S11 is affirmative, the number of the originals mounted on the original-mounting tray 1 is counted by performing the conveyance control shown in FIGS. 3(A)–3(E) (the reading processing shown in FIG. 3(C) is not performed) (step S12).

In step S13, the microprocessor M determines if the counting of the number of the originals has been completed. If the result of the determination in step S13 is affirmative, the count value is output to the controller C of the main body of the copier as a part of an original-detection signal, and the conveying processing in the 2-in-1/lower-sheet separation mode shown in FIGS. 5(A)–5(G) is performed (step S14), and the process returns to step S1. If the result of the determination in step S11 is negative, the process proceeds to step S14 by skipping steps S12 and S13. In step S14, the conveying processing in the 2-in-1/lower-sheet separation mode shown in FIGS. 5(A)–5(G) is performed.

Every time an original-feeding signal from the controller C is "on" in step S2, the above-described series of sheet feeding/discharging operations are repeated. The main body of the copier turns on an original-discharging signal when all of the originals have been fed from the original-mounting tray 1 of the RDF, or when the operation is interrupted by depression of a stop key. If an original-discharging signal is "on", all read originals mounted on the platen glass 15 are discharged onto the original-mounting tray 1 (step S16), and the process returns to step S1. On the other hand, if an original-discharging signal is "off", the process returns to step S2.

If the result of the determination in step S1 is negative, i.e., if the microprocessor M has determined that the upper-sheet separation mode is set, the microprocessor M then determines if an original-feeding signal input from the controller C is "on" (step S17). If the result of the determination in step S17 is affirmative, the microprocessor checks an operational-mode signal input from the controller C, and determines if the simplex-original mode is set (step S18).

If the result of the determination in step S18 is affirmative, i.e., if the simplex-original/upper-sheet separation mode is set, the conveying processing in the simplex-original/upper-sheet separation mode shown in FIGS. 6(A)–6(E) is performed (step S19), and the process returns to step S1. That is, the counting of the number of the originals is not performed in the simplex-original/upper-sheet separation mode.

If the result of the determination in step S18 is negative, the microprocessor M then determines if the duplex-original mode is set (step S20). If the result of the determination in step S20 is affirmative, i.e., if the duplex-original/upper-sheet separation mode is set, the conveying processing in the duplex-original/upper-sheet separation mode shown in FIGS. 7(A)–7(I) is performed (step S21), and the process returns to step S1. That is, the counting of the number of the originals is not performed in the duplex-original/upper-sheet separation mode.

If the result or the determination in step S20 is negative, the microprocessor M then determines if the 2-in-1 mode is set (step S22). If the result of the determination in step S22 is affirmative, i.e., if the 2-in-1/upper-sheet separation mode is set, the conveying processing in the 2-in-1/upper-sheet separation mode shown in FIGS. 8(A)–8(F) is performed, and the process returns to step S1.

Every time an original-feeding signal from the controller C is "on" in step S17, the series of sheet feeding/discharging operations are repeated. The main body or the copier turns on an original-discharging signal when all of the originals have been fed from the original-mounting tray 1 of the RDF, or when the operation is interrupted by depression of the stop key. If an original-discharging signal is "on", all read originals mounted on the platen glass 15 are discharged onto the discharged-original tray 33 (step S25), and the process returns to step S1. On the other hand, if an original-discharging signal is "off", the process returns to step S17.

As described above, in the present embodiment, by providing an original-reversal mechanism, it is possible to perform an original-conveying operation in the duplex-original/lower-sheet separation mode and in the 2-in-1/lower-sheet separation mode. When performing upper-sheet separation mainly in order to perform facsimile transmission processing, the counting of the number of originals is not performed at all. Even when performing lower-sheet separation in order to perform copying processing, the counting of the number of originals is not performed in the duplex-original mode. The counting of the number of originals is performed only in the simplex-original mode and in the 2-in-1 mode. That is, by counting the number of originals only when it is necessary to do the counting, the original-processing time period is shortened.

The individual components shown in outline or designated by blocks are all well known in the original-feeding device arts and their specific construction and operation are not critical to the operation or the best mode for carrying out the invention.

While the present invention has been described with respect to what is presently considered to be the preferred embodiment, it is to be understood that the invention is not limited to the disclosed embodiment. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An original-feeding device in which originals are conveyed from an original-tray, on which a bundle of originals can be mounted, to an original-reading mount, comprising:

separation means for selectively separating originals from the bundle of originals mounted to have a first page on top on the original-tray either from an uppermost original or from a lowermost original;

convey means for conveying the originals from said separation means to the original-reading mount; and control means for controlling said separation means and said convey means to juxtapose two consecutive originals on the original-reading mount irrespective of whether the originals are separated and fed from the uppermost original or from the lowermost original, wherein said control means controls said convey means to perform a first conveying sequence when the originals are conveyed from the uppermost original and a second conveying sequence, different than the first conveying sequence, when the originals are conveyed from the lowermost original, and further, the position of juxtaposing said two consecutive originals is reversed between said first conveying sequence and said second conveying sequence.

2. An original-feeding device according to claim 1, wherein said control means further counts the number of originals in the bundle of originals mounted on the original-tray only when the originals from the bundle of originals are separated from the lowermost original.

3. An original-feeding device in which originals are conveyed from an original-tray, on which a bundle of originals can be mounted, to an original-reading mount, comprising:

separation means for selectively separating originals from the bundle of originals mounted on the original-tray either from an uppermost original or from a lowermost original;

convey means for conveying the originals from said separation means to the original-reading mount; and control means for controlling said separation means and said convey means to juxtapose two consecutive originals on the original-reading mount irrespective of whether the originals are separated and fed from the uppermost original or from the lowermost original, wherein said control means further counts the number of originals in the bundle of originals mounted on the original-tray only when the originals from the bundle of originals are separated from the lowermost original, and wherein said control means counts the number of originals in the bundle of originals mounted on the original-tray when each of the originals has information recorded on only one side, which is placed on the original-reading amount.

4. An original-feeding device in which originals are conveyed from an original-tray, on which a bundle of originals can be mounted, to an original-reading mount, comprising:

separation means for selectively separating originals from the bundle of originals mounted on the original-tray either from an uppermost original or from a lowermost original;

convey means for conveying the originals from said separation means to the original-reading mount; and control means for controlling said separation means and said convey means to juxtapose two consecutive originals on the original-reading mount irrespective of whether the originals are separated and fed from the uppermost original or from the lowermost original, wherein said control means further counts the number of originals in the bundle of originals mounted on the original-tray only when the originals from the bundle of originals are separated from the lowermost original, and wherein said control means counts the number of originals in the bundle of originals mounted on the original-tray when the two consecutive originals are to be juxtaposed on the original-reading mount.

5. An original-feeding device in which originals are conveyed from an original-tray, on which a bundle of originals can be mounted, to an original-reading mount, comprising:

separation means for selectively separating originals from the bundle of originals mounted to have a first page on top on the original-tray either from an uppermost original or from a lowermost original;

convey means for conveying the originals from the separation means to the original-reading mount;

count means for counting the number of originals by feeding the originals from the bundle of originals mounted on the original-tray; and control means for controlling said separation means, said convey means and said count means, to perform a first conveying sequence when the originals are conveyed from the uppermost original and a second conveying sequence, different than the first conveying sequence, when the originals are conveyed from the lowermost original, wherein said control means prohibits counting by said count means during said first conveying sequence, and permits counting during said second conveying sequence.

6. An original-feeding device in which originals are conveyed from an original-tray, on which a bundle of originals can be mounted, to an original-reading mount, comprising:

separation means for selectively separating originals from the bundle of originals mounted on the original-tray either from an uppermost original or from a lowermost original;

convey means for conveying the originals from the separation means to the original-reading mount; and control means for controlling said separation means and said convey means and counting the number of originals in the bundle of originals mounted on the original-tray only when the originals from the bundle of originals are separated and fed from the lowermost original, wherein said control means counts the number of originals in the bundle of originals mounted on the original-tray when each of the originals has information recorded on only one side, which side is placed on the original-reading mount.

7. An original-feeding device in which originals are conveyed from an original-tray, on which a bundle of originals can be mounted, to an original-reading mount, comprising:

separation means for selectively separating originals from the bundle of originals mounted on the original-tray either from an uppermost original or from a lowermost original;

convey means for conveying the originals from the separation means to the original-reading mount; and control means for controlling said separation means and said convey means and counting the number of originals in the bundle of originals mounted on the original-tray only when the originals from the bundle of originals are separated and fed from the lowermost original, wherein said control means counts the number of originals in the bundle of originals mounted on the original-tray when the two consecutive originals are to be juxtaposed on the original-reading mount.

8. An original-feeding device in which originals are conveyed from an original-tray, on which a bundle of originals can be mounted, to an original-reading mount, comprising:

control means for controlling an original-conveying operation so as to selectively separate and feed originals from the bundle of originals mounted on the original-tray onto the original-reading mount either from an uppermost original or from a lowermost original, wherein said control means can control the original-conveying operation to juxtapose two consecutive originals on the original-reading mount irrespective of whether the originals are separated and fed from the uppermost original or from the lowermost original, and wherein said control means further counts the number of originals in the bundle of originals mounted on the original-tray only when the originals from the bundle of originals are separated and fed from the lowermost original, and each of the originals has information recorded on only one side, which is placed on the original-reading mount.

9. An original-feeding device in which originals are conveyed from an original-tray, on which a bundle of originals can be mounted, to an original-reading mount, comprising:

separation means for selectively separating originals from the bundle of originals mounted to have a first page on top on the original-tray either from an uppermost original or from a lowermost original;

convey means for conveying the originals from the separation means to the original-reading mount;

count means for counting the number of originals by feeding the originals from the bundle of originals mounted on the original-tray; and control means for enabling an operation of said count means in a lowermost separation mode in which the originals from the bundle are separated from the lowermost original, and for disabling the operation of said count means in an uppermost separation mode in which the originals from the bundle are separated from the uppermost original, wherein, in the lowermost separation mode, said control means further disables the operation of said count means in a double-sided mode of reading images on both sides of the original, and enables the operation of said count means in a one sided mode in which an image on one side of an original is read.

10. An original-feeding device according to claim 9, wherein the mode of separating from the lowermost original is a copying mode, and the mode of separating from the uppermost original is a facsimile-transmission mode.

11. An original-feeding device according to claim 9, wherein said control means further disables the operation of said count means in a double-sided mode of reading images on both sides of the original.

12. An original-feeding device according to claim 9, further comprising input means for inputting a signal from an image reading device, said input means connected to the original-feeding device, wherein said control means further controls whether the originals are separated from the uppermost original or from the lowermost original based on the signal from said input means.

13. An original-feeding device according to claim 12, wherein said control means controls the operation of said count means based on the signal from said input means.

14. An original-feeding device according to claim 12, wherein the signal from said input means indicates whether the original is a single-sided original or a double-sided original.

15. An original-feeding device in which originals are conveyed from an original-tray, on which a bundle of originals can be mounted to have a first page on top, to an original-reading mount, comprising:

feeding means for selectively separating originals from the original tray either from an uppermost original or from a lowermost original;

a forward conveyance path through which separated originals can be conveyed to the original-reading mount;

a reverse conveyance path through which separated originals can be conveyed from the original-reading mount to the original tray;

a gate for selectively routing separated originals from said reverse conveyance path either to said forward conveyance path or to said original tray; and control means for controlling an original-conveying operation so as to (a) selectively separate and convey originals from the bundle of originals mounted on the original-tray onto the original-reading mount either from the uppermost original or from the lowermost original and (b) selectively juxtapose two consecutive originals on the original-reading mount irrespective of whether the originals are separated and fed from the uppermost original or from the lowermost original, wherein said control means controls said convey means to perform a first conveying sequence when the originals are conveyed from the uppermost original and a second conveying sequence, different than the first conveying sequence, when the originals are conveyed from the lowermost original, and further, between said first conveying sequence and said second conveying sequence, when said two consecutive originals are juxtaposed, the controls of said forward conveyance path, said reverse conveyance path and said gate are selectively different.

16. An original-feeding device according to claim 15, wherein, only when the originals from the bundle of originals are to be separated and fed from the lowermost original, said control means counts the number of originals in the bundle of originals mounted on the original-tray.

17. An original-feeding device in which originals are conveyed from an original-tray, on which a bundle of originals can be mounted, to an original-reading mount, comprising:

feeding means for selectively separating originals from the original tray either from an uppermost original or from a lowermost original;

a forward conveyance path through which separated originals can be conveyed to the original-reading mount;

a reverse conveyance path through which separated originals can be conveyed from the original-reading mount to the original tray;

a gate for selectively routing separated originals from said reverse conveyance path either to said forward conveyance path or to said original tray; and control means for controlling an original-conveying operation so as to (a) selectively separate and convey originals from the bundle of originals mounted on the original-tray onto the original-reading mount either from the uppermost original or from the lowermost original and (b) selectively juxtapose two consecutive originals on the original-reading mount irrespective of whether the originals are separated and fed from the uppermost original or from the lowermost original, wherein said control means counts the number of originals in the bundle of originals mounted on the original-tray when each of the originals has information recorded on only one side, which is placed on the original-reading mount.

18. An original-feeding device in which originals are conveyed from an original-tray, on which a bundle of originals can be mounted, to an original-reading mount, comprising:

feeding means for selectively separating originals from the original tray either from an uppermost original or from a lowermost original;

a forward conveyance path through which separated originals can be conveyed to the original-reading mount;

a reverse conveyance path through which separated originals can be conveyed from the original-reading mount to the original tray;

a gate for selectively routing separated originals from said reverse conveyance path either to said forward conveyance path or to said original tray; and control means for controlling an original-conveying operation so as to (a) selectively separate and convey originals from the bundle of originals mounted on the original-tray onto the original-reading mount either from the uppermost original or from the lowermost original and (b) selectively juxtapose two consecutive originals on the original-reading mount irrespective of whether the originals are separated and fed from the uppermost original or from the lowermost original, wherein said control means counts the number of originals in the bundle of originals mounted on the original-tray when the two consecutive originals are to be juxtaposed on the original-reading mount.

19. An original-feeding method of conveying originals from an original-tray to an original-reading mount, comprising the steps of:

selectively separating and feeding the originals from a bundle of originals mounted to have a first page on top on the original-tray toward the original-reading mount either from an uppermost original or from a lowermost original; and selectively juxtaposing two consecutive originals on the original-reading mount when the originals are separated and fed either from the uppermost original or from the lowermost original, wherein, in said juxtaposing step, a first conveying sequence is performed when the originals are conveyed from the uppermost original and a second conveying sequence, different than the first conveying sequence, is performed when the originals are conveyed from the lowermost original, and further, the position of juxtaposing said two consecutive originals is reversed between said first conveying sequence and said second conveying sequence.

20. An original-feeding method according to claim 19, further comprising the step of, only when the originals from the bundle of originals are to be separated and fed from the lowermost original, counting the number of originals in the bundle of originals mounted on the original-tray.

21. An original-feeding method of conveying originals from an original-tray to an original-reading mount, comprising the steps of:

selectively separating and feeding the originals from a bundle of originals mounted on the original-tray toward the original-reading mount either from an uppermost original or from a lowermost original;

selectively Juxtaposing two consecutive originals on the original-reading mount when the originals are separated and fed either from the uppermost original or from the lowermost original; and only when the originals from the bundle of originals are to be separated and fed from the lowermost original, counting the number of originals in the bundle of originals mounted on the original tray, wherein said counting step is performed when each of the originals has information recorded on only one side which is placed on the original-reading mount.

22. An original-feeding method of conveying originals from an original-tray to an original-reading mount, comprising the steps of:

selectively separating and feeding the originals from a bundle of originals mounted on the original-tray toward the original-reading mount either from an uppermost original or from a lowermost original;

selectively juxtaposing two consecutive originals on the original-reading mount when the originals are separated and fed either from the uppermost original or from the lowermost original; and only when the originals from the bundle of originals are to be separated and fed from the lowermost original, counting the number of originals in the bundle of originals mounted on the original tray, wherein said counting step is performed when the two consecutive originals are to be juxtaposed on the original-reading mount.

23. An original-feeding method of conveying originals from an original tray to an original-reading mount comprising the steps of:

selectively separating and feeding the originals from a bundle of originals mounted and having a first page on top on the original-tray toward the original-reading mount either from an uppermost original or from a lowermost original;

selectively counting the number of originals mounted on the original tray in a lowermost separation mode in which the originals are separated and fed from the lowermost original and not in an uppermost separation mode in which the originals are separated and fed from the uppermost original, wherein in the lowermost separation mode the number of originals are not counted in said counting step in the case of a double-sided mode of reading images on both sides of the original, and the number of originals are counted in said counting step in the case of a one-sided mode in which an image on one side of an original is read.

24. An original-feeding method according to claim 23, wherein the mode of feeding from the lowermost original is a copying mode, and the mode of feeding from the uppermost original is a facsimile-transmission mode.

25. An original-feeding method according to claim 23, further comprising the step of inputting a signal from an image reading device, the image reading device being connected to the original-feeding device, wherein whether the originals are separated and fed from the uppermost original or from the lowermost original in said selectively separating and feeding step is switched based on the input signal.

26. An original-feeding method according to claim 25, wherein, even in the mode in which the originals are separated and fed from the lowermost original, the operation of said counting step is controlled based on the input signal.

27. An original-feeding method according to claim 26, wherein the input signal includes a signal indicating whether the original is a single-sided original or a double-sided original.

28. An original-feeding method of conveying originals from an original-tray to an original-reading mount, comprising the step of:

controlling an original-conveying operation so as to selectively separate and feed the originals from a bundle of originals mounted on the original-tray onto the original-reading mount either from an uppermost original or from a lowermost original, wherein said control step can include controlling the original-conveying operation to juxtapose two consecutive originals on the original-reading mount when the originals are separated and fed either from the uppermost original or form the lowermost original, wherein said control step further includes counting the number of originals in the bundle of originals mounted on the original-tray only when the originals from the bundle of originals are separated and fed from the lowermost original, and each of the originals has information recorded on only one side, which is placed on the original-reading mount.

* * * * *

UNITED STATES PATENT AND TRADEMARK OFFICE

CERTIFICATE OF CORRECTION

PATENT NO. : 6,118,971

DATED : September 12, 2000

INVENTOR(S): SHUNJI SATO, ET AL.

It is certified that error appears in the above-identified patent and that said Letters Patent is hereby corrected as shown below:

COVER PAGE AT ITEM [57] ABSTRACT:
Line 11, "lower-most" should read --lowermost--.

COLUMN 6:
Line 28, "memory 53)" should read --memory)--; and "memory." should read --memory 53.--; and
Line 34, "platen" should read --plate--.

COLUMN 8:
Line 20, "7(F))," should read --7(E)),--; and
Line 25, "duplex-original/upper-sleet" should read --duplex-original/upper-sheet--.

COLUMN 12:
Line 5, "amount." should read --mount.--.

UNITED STATES PATENT AND TRADEMARK OFFICE

CERTIFICATE OF CORRECTION

PATENT NO. : 6,118,971

DATED : September 12, 2000

INVENTOR(S): SHUNJI STAO, ET AL.

It is certified that error appears in the above-identified patent and that said Letters Patent is hereby corrected as shown below:

COLUMN 16:
Line 31, "Juxtaposing" should read --juxtaposing--.

Signed and Sealed this

First Day of May, 2001

*Attest:*

Nicholas P. Godici

NICHOLAS P. GODICI

*Attesting Officer*

*Acting Director of the United States Patent and Trademark Office*